US006119851A

United States Patent [19]

Paciello

[11] Patent Number: 6,119,851

[45] Date of Patent: Sep. 19, 2000

[54] CONTAINER FOR NOTEPADS, PAPER CLIPS, STAPLES AND THE LIKE

[75] Inventor: Roberto Paciello, Cassano D'Adda, Italy

[73] Assignee: Make S.R.L., Cusano Milanino, Italy

[21] Appl. No.: 09/206,370

[22] Filed: Dec. 7, 1998

[30] Foreign Application Priority Data

Jul. 31, 1998 [IT] Italy ..... PC980017 U

[51] Int. Cl.[7] ..... B65D 43/22; B65D 43/24

[52] U.S. Cl. ..... 206/45.23; 220/819; 220/823; 220/827; 206/214

[58] Field of Search ..... 206/45.2, 45.23, 206/214, 371; 220/333, 334, 335, 337, 817, 819, 820, 822, 823, 827, 830

[56] References Cited

U.S. PATENT DOCUMENTS 2,860,767 11/1958 Shiffman ..... 206/45.23
3,292,633 12/1966 Punzel ..... 206/45.23
3,297,151 1/1967 Palson ..... 206/45.23
3,338,391 8/1967 Palson ..... 206/45.23

*Primary Examiner*—Jacob K. Ackun
*Attorney, Agent, or Firm*—Young & Thompson

[57] ABSTRACT

Desk container, in particular for notepads, paper clips, staples and the like, including a roughly box-shaped base and a lid. The lid is subject to the action of elastic systems which, on opening, cause it to rotate so that it rests on the desk top and raises the rear part of the container. The lid is divided into two parts hinged to one another, one of which is hinged to the base in such a way as to counteract elastic systems, while the other presents a closing assembly consisting of suitably shaped elastic arms or the like, designed to engage the walls of the container and keep the lid in the closed position, counteracting the elastic systems.

13 Claims, 3 Drawing Sheets

CONTAINER FOR NOTEPADS, PAPER CLIPS, STAPLES AND THE LIKE

BACKGROUND OF THE INVENTION

This application relates to a desk container designed especially to contain notepads such as the type called "POST-IT"®, paper clips, staples and the like, as well as small instruments like calculating machines, or money-change calculators.

In particular, it relates to a container fitted with systems that facilitate the opening and closing stages and place the container in a tilted position on opening, so as to make its use more convenient.

Stands or containers for articles of stationery used during office work are routinely placed on desks; the configuration of these containers often fulfils a dual function, namely to keep the workplace tidy and to make it convenient or easy for the user to remove or use the object.

In addition to the various types of pen holders and containers for objects, box-type containers of various sizes are often used to contain articles such as paper clips, paper, notepads and the like.

These containers are made with various systems and in a variety of shapes; however, especially in the case of models with an opening lid, they present the drawback that the opening and closing systems are often inconvenient.

For example, some containers have a hinged leaf opening system, others have a roll-top closing system, and others have doors with catches that are often made with complex, impractical systems.

Moreover, the use of these containers is not particularly convenient because they are laid perfectly flat on the work-top; this position does not facilitate the removal or use of the objects contained in them, whereas it would be far more convenient to use a container with a raised top part.

SUMMARY OF THE INVENTION

The purpose of this invention is to provide a desk container specifically designed to contain items of stationery, and in particular notepads or paper, paper clips, staples and the like, which comprises a simplified opening and closing system and a special articulated lid which, when opened, places the container in an inclined position, with the rear section raised.

A further purpose of the invention is to offer a container that is simple to construct, which means very low manufacturing costs, and very simple and convenient to use, as the inclined position adopted on opening facilitates removal of the objects contained in it and above all makes writing on notepads or other similar uses very convenient.

The purposes and advantages described above are achieved, in accordance with the invention, by a desk container, in particular for notepads, paper clips, staples and the like, comprising a base which is roughly box-shaped or of another more suitable shape and a lid, characterised by the fact that the said lid is divided longitudinally into two parts hinged to one another, one of which is constrained to the said base by a rotation assembly that counteracts elastic systems, while the other is fitted with a closing assembly constituted by suitably shaped elastic arms or the like, which elastically engage the walls of the container to keep the lid in the closing position.

BRIEF DESCRIPTION OF THE DRAWINGS

Further characteristics and details of the invention will appear more clearly from the following detailed description, given by way of example but not of limitation, by reference to the annexed drawings, in which.

DESCRIPTION OF THE PREFERRED EMBODIMENTS

Figure 1:
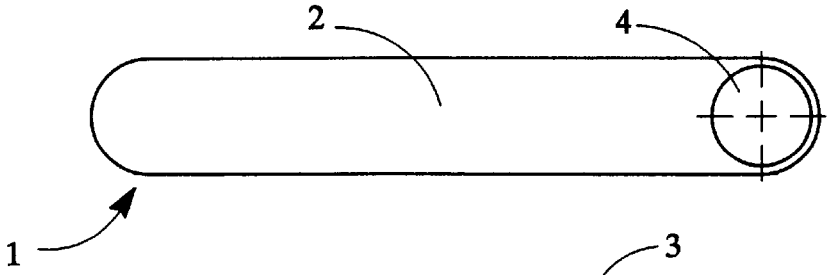
FIG. 1 schematically represents an overall view of the container in accordance with the invention, seen from the side FIG. 2 schematically illustrates a plan view of the container in the closed position FIG. 3 schematically represents a perspective view of the container in the open position FIGS. 4 and 5 schematically show lateral and plan views respectively of the container in the open position FIG. 6 schematically illustrates the part that couples the articulated lid to the base FIGS. 7 and 8 schematically illustrate the operation of the lid release mechanisms.
Figure 2:
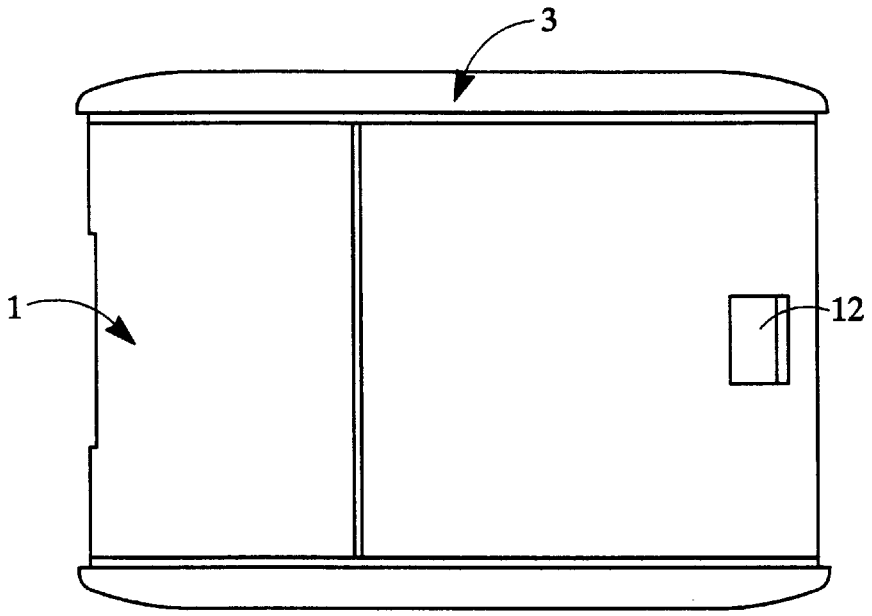

By reference to the annexed figures, no. 1 indicates a container in accordance with the invention as a whole, the said container being basically constituted by a base 2 and a lid 3, which said lid is fixed to the base by a hinge assembly 19.

The said hinge assembly is constituted by roughly cylindrical elements 5 and 6, one of which is integral with the base and the other with the lid, while a pin not illustrated in the figure runs through the said cylindrical elements.

A coil spring 4 is fitted inside cylindrical elements 5 and 6.

Lid 3 is formed by two parts 8 and 9, constrained to one another by a hinge 7, part 9 being integral with cylindrical element 6 of hinge assembly 19.

The two halves which form the lid are preferably not identical, but of different dimensions.

Projecting part 8 is proportionally larger than part 9, which is fixed to the base; for example, according to one possible configuration, the former could constitute two-thirds and the latter one-third of the lid surface.

Part 8 of the lid also comprises a catch assembly that allows the lid to close on the base.

This catch assembly consists of a clip 11 integral with a set of elastic operating arms 10 which have a symmetrical angled shape and are joined in the middle to form a U-shaped projection that constitutes the said clip 11.

The latter is inserted in a hollow casing 12 fitted on the inside of the lid. Clip 11 can be moved backwards and forwards, sliding inside casing 12. Arms 10 are constituted by a number of consecutive sections fitted at an angle to one another; fixed pins 13, which act as positioning and guide elements during the movement of the arms, are fitted at each angle.

The elastic force of the arms normally causes them to take up a position with the ends projecting from the sides of the lid, so that they are inserted in the corresponding housings in the side walls of the container to keep the lid in the closed position.

Figure 3:
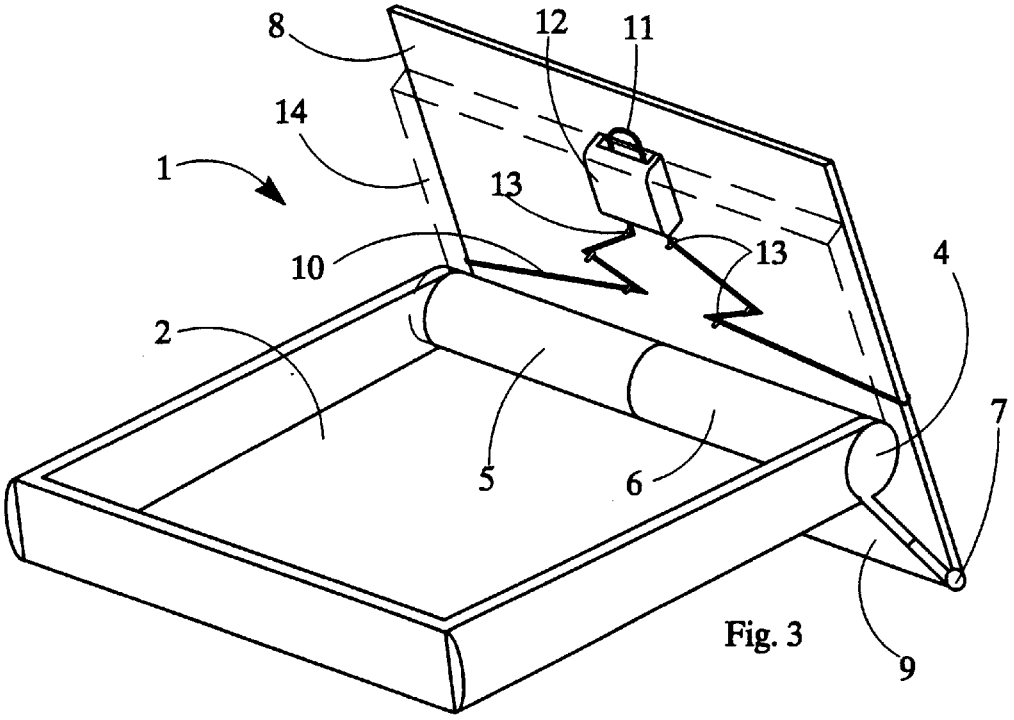
Figure 4:
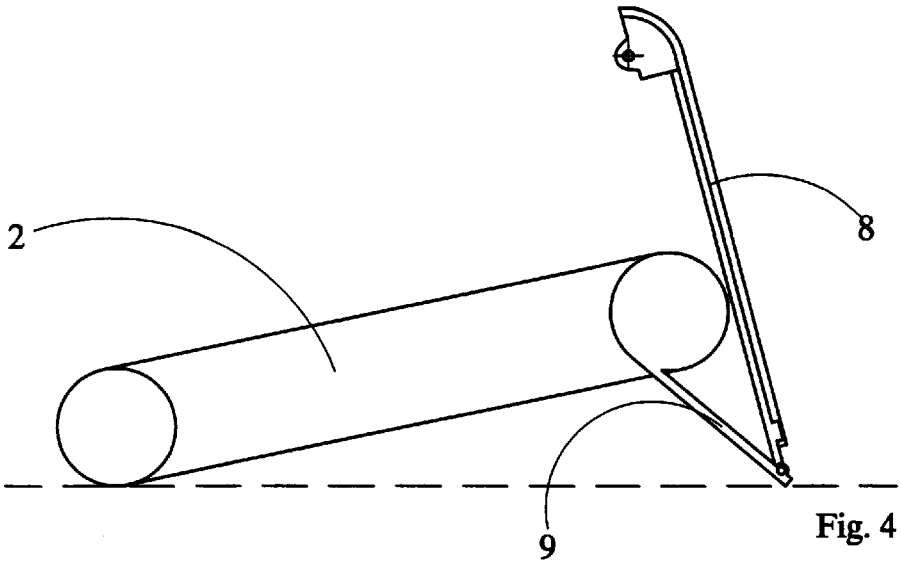
Figure 5:
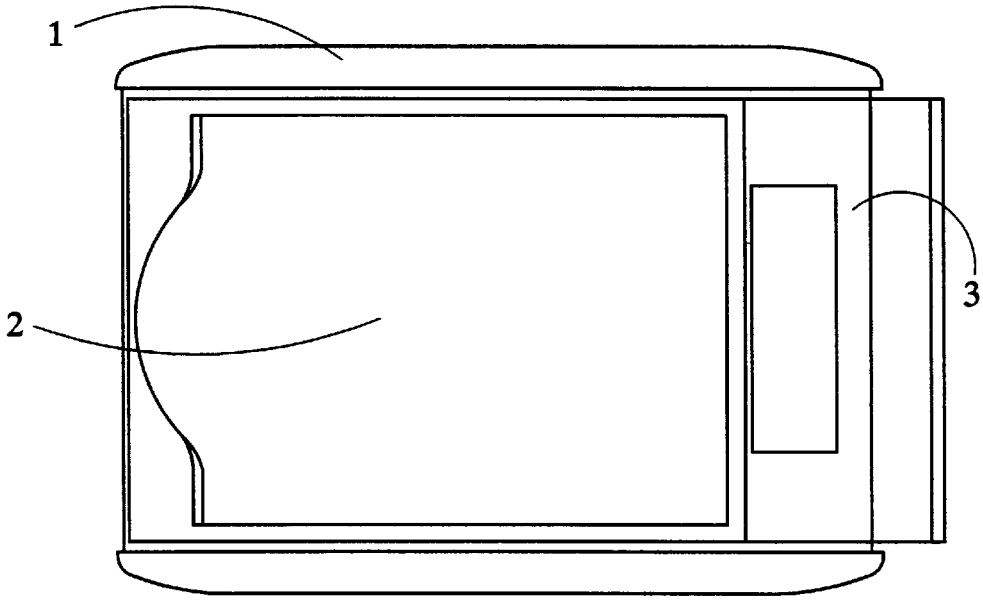
Figure 6:
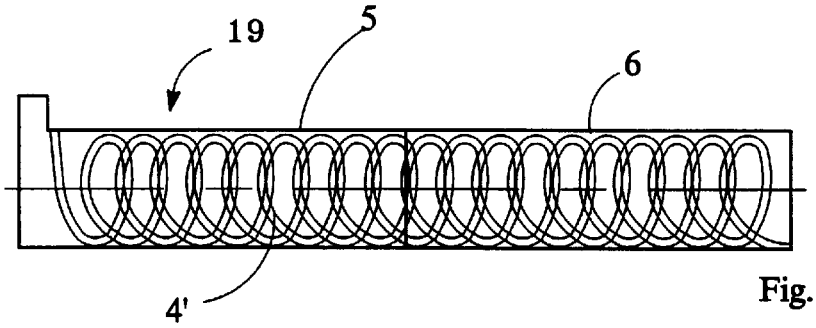
Figure 8:
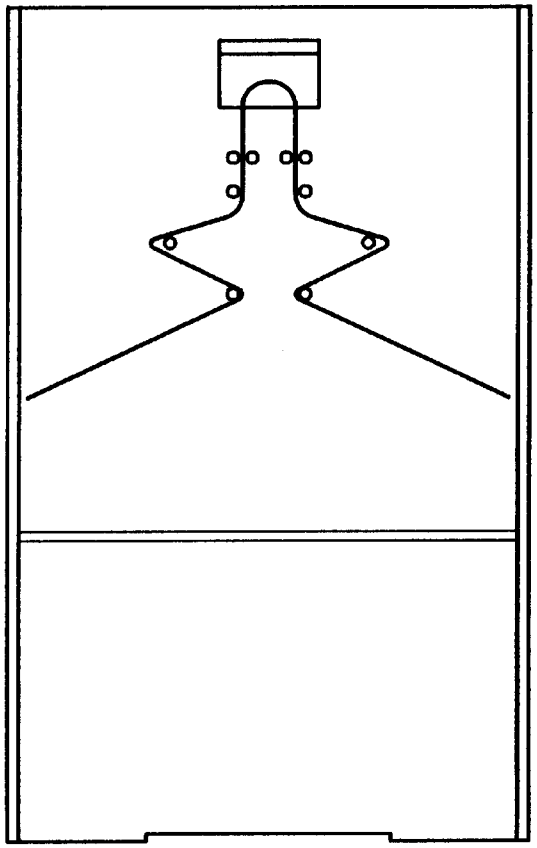
Figure 7:
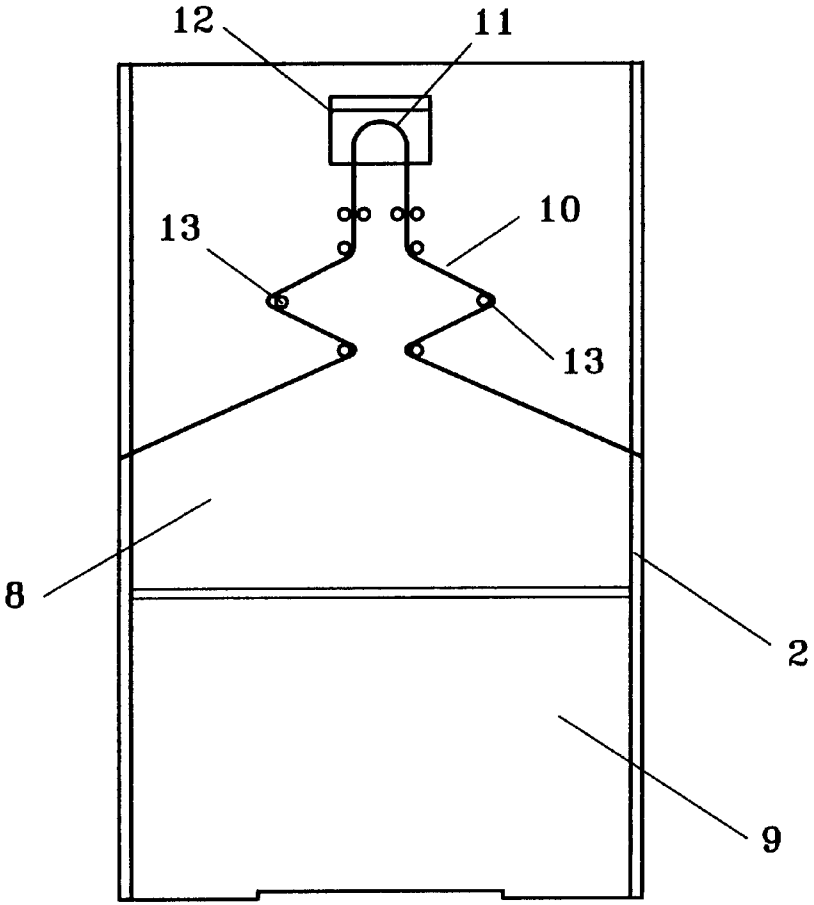

When clip 11 is pushed backwards arms 10 slide round pins 13, taking on the configuration shown in FIG. 8, and fully retract inside the lid, which is thus released and moves into the open position shown in FIGS. 3 and 4.

A panel 14 fixed to lid 8 prevents the arms from exiting from their seatings.

As can be seen from the figures, when the container is in the closed position it presents a normal, roughly parallelepiped-shaped box configuration, whereas in the open position, which is obtained simply by pressing elastic clip 11 with the finger from the outside, the container clicks backwards as a result of the action of spring 4 and takes up the position shown in FIGS. 3 and 4.

In the open position, base 2 of the box is inclined, and supported by part 9 of the lid. In practice, the lid holds the rear side of the base in the raised position, resting on the wall of hinge 7.

The inclined position of the base facilitates use of the container because it faces towards the person sitting at the desk, who will therefore find it easier to take objects from it and to write on sheets of paper or notepads.

As indicated, the container of the invention could be also used for small instruments like calculating machines, or money-change calculators.

An expert in the field could devise a number of variations, all of which should be deemed to fall within the scope of this invention.

What is claimed is:

1. A container comprising:

a base having a closed bottom and an open top;

a lid having a first part and a second part that each close a respective portion of said open top;

a first hinge pivotally joining said first and second parts; and a spring hinge pivotally joining said first part to said base and urging said first part from a closed position where said first part closes the respective portion of said open top to an open position that is more than 180° removed from said closed position, said base being inclined and supported by a portion of said lid adjacent to said first hinge when said first part is in the open position.

2. The container of claim 1, further comprising a latch releasably attaching said second part to said base when said first part is in the closed position.

3. The container of claim 2, wherein said latch is carried by said second part and comprises elastic arms extending symmetrically from a movable clip, distal ends of said arms engaging said base when said first part is the closed position and disengaging from said base, permitting said spring hinge to urge said first part to the open position, when said clip is actuated.

4. The container of claim 3, wherein said second part comprises pins which direct movement of said elastic arms to disengage said distal ends from said base when said clip is actuated.

5. The container of claim 1, wherein said spring hinge comprises a coil spring at a side of said closed bottom.

6. The container of claim 5, wherein each of said base and said first part comprises a cylinder housing a portion of said coil spring.

7. The container of claim 1, wherein said first part of said lid closes a smaller respective portion of said open top than said second part.

8. The container of claim 1, wherein said bottom is a parallelepiped, and wherein said lid is generally planar when said first part is in the closed position.

9. A container comprising:

a base having a closed bottom and an open top;

a lid closing said open top;

a spring hinge pivotally joining said lid to said base and urging said lid from a closed position where said lid closes said open top to an open position where a part of said lid is more than 180° removed from said closed position; and a latch releasably attaching said lid to said base when said lid is in the closed position, said latch being carried by said lid opposite said spring hinge and comprising elastic arms extending symmetrically from a movable clip, distal ends of said arms engaging respective sides of said base when said lid is in the closed position and disengaging from the sides of said base when said clip is actuated, permitting said spring hinge to urge said lid to the open position.

10. The container of claim 9, wherein said lid comprises pins which direct movement of said elastic arms to disengage said distal ends from the sides of said base when said clip is actuated.

11. The container of claim 10, wherein said elastic arms have a zigzag pattern with one of said pins at each corner of said zigzag pattern.

12. The container of claim 9, where said lid comprises a first part and a second part that each close a respective portion of said open top and a first hinge pivotally joining said first and second parts, said spring hinge pivotally joining said first part to said base and urging said first part from a closed position where said first part closes the respective portion of said open top to an open position that is more than 180° removed from said closed position.

13. The container of claim 9, wherein said spring hinge comprises a coil spring at a side of said closed bottom.

* * * * *